United States Patent [19]

Rémond

[11] 4,134,436

[45] Jan. 16, 1979

[54] MECHANICAL WEFT-THREAD SELECTOR FOR A SHUTTLELESS LOOM

[75] Inventor: Pierre Rémond, Bourgoin-Jallieu (Isere), France

[73] Assignee: Saurer Diederichs, Societe Anonyme, Bourgoin-Jallieu (Isere), France

[21] Appl. No.: 849,246

[22] Filed: Nov. 7, 1977

[30] Foreign Application Priority Data

Nov. 5, 1976 [FR] France ..... 76 34053

[51] Int. Cl.[2] ..... D03D 47/38

[52] U.S. Cl. ..... 139/453

[58] Field of Search ..... 139/450, 453; 66/133

[56] References Cited

U.S. PATENT DOCUMENTS

| | | | |
|---|---|---|---|
| 3,439,715 | 4/1969 | Juillard | 139/453 |
| 3,731,712 | 5/1973 | Sermet | 139/453 |
| 3,754,578 | 8/1973 | Remond | 139/453 |
| 3,903,930 | 9/1975 | Muller | 139/453 |
| 3,915,200 | 10/1975 | Morris | 139/453 |

*Primary Examiner*—Henry Jaudon

*Attorney, Agent, or Firm*—Karl F. Ross

[57] ABSTRACT

The relative movements of the sheath and core wire of a bowden cable are used to generate a multiplicity of modes of color selection of a weft-thread selector for a shuttleless loom. The single cable is the sole connection between the drawbar assembly and the dobby.

11 Claims, 13 Drawing Figures

MECHANICAL WEFT-THREAD SELECTOR FOR A SHUTTLELESS LOOM

FIELD OF THE INVENTION

The present invention relates to a weft-thread selector for a shuttle-less loom and, more particularly, to an improvement over the system described in U.S. Pat. No. 3,731,712.

BACKGROUND OF THE INVENTION

In the selector of this patent, the raising of each drawbar, at the time of its selection, is ensured by an individual control by electromagnet. Each drawbar comprises an extension below which is located an electromagnet whose movable core causes raising of the drawbar when the electromagnet is excited.

This solution requires not only electromagnets, but also miniature contact breakers, relays, connecting wires etc. If thus leads to a certain complexity of construction, hence a relatively high cost price, insufficient reliability and it is difficult to maintain, since experts in this field are more familiar with mechanical devices than with electrical systems.

To remedy these drawbacks and in particular the last drawback mentioned above, it is particularly advantageous to provide a purely mechanical solution. However, completely mechanical weft thread selectors as used at present are themselves quite complex. In fact, the control of thread guides in the latter is generally achieved from the movements of the dobby levers, by by means of an arrangement of cables, the number of which is equal to the number of thread guides. Furthermore, the selection of each thread guide and the possible locking operations are also ensured by individual means, i.e. means which have to be multiplied by four for example in the case of a loom with weft threads of four different colors.

OBJECTS OF THE INVENTION

It is an object of the present invention to provide a purely mechanical weft-thread selector which is much simpler than prior-art systems, requiring only a single control cable even for a loom weaving with four weft threads, comprising selection and locking means common to all the thread guides and thus constituting a selector of low cost price and increased reliability.

Another object is to provide a weft-thread selector which is simpler than the system of the aforementioned patent.

SUMMARY OF THE INVENTION

To this end, the invention relates to a weft-thread selector in which each of the weft threads is engaged in the eye of a pivoted thread guide and connected to a drawbar which, at the time of its selection, is raised and engaged on a plate carrying out an alternating rectilinear movement. The corresponding thread guide thus brings the selected weft thread into the passage of the insertion member. The drawbars are arranged side by side. According to the invention the selected drawbar is controlled by a lever pivotally mounted about a pivot, able to cooperate with all the drawbars and connected to one end of a bowden cable passing through a sheath whereof the mouthpiece close to this end is fixed, the other end of the cable and the corresponding mouthpiece of the sheath both being movable, their movements being controlled by a device associated with two dobby levers.

In order to facilitate the movements, each drawbar preferably comprises a roller cooperating with the end of the lever, the various rollers being arranged on the circular-arc trajectory described by this end of the lever.

When the end of the lever constituting the selection member common to all the thread guides is brought under the roller connected to the drawbar to be selected, the latter is raised and engaged on the plate, which thus entrains the latter in its reciprocating movement such that the thread guide coupled to the drawbar in question brings the selected thread into the passage of the weft insertion member.

A single mouthpiece of the sheath is fixed, which makes it possible to control the movement of the first end of the cable, i.e. the end connected to the lever, in a very particular manner, by simultaneously controlling the movements of the second end of the cable and of the movable mouthpiece of the sheath. According to one embodiment, the second end of the cable is integral with a member pivoted to an extension of a first dobby lever, whereas the corresponding movable mouthpiece of the sheath is integral with a member pivoted to an extension of a second dobby lever.

Advantageously, the member integral with the movable mouthpiece of the sheath is supported by a connecting rod pivoted to a fixed member, arranged such that the pivot point of the dobby levers, the pivot point of the aforesaid part of the extension of the second dobby lever, the pivot point of the connecting rod on the said part and the pivot point of the connecting rod on the fixed member constitute the corners of a deformable parallelogram. This arrangement makes it possible to keep the considered mouthpiece of the sheath parallel to itself, although the latter is movable, and thus retain a constant and correct orientation of certain moving parts of the device.

According to a particularly advantageous arrangement, the distance separating the pivot point of the member integral with the end of the cable and the pivot point of the dobby levers is substantially equal to twice the distance separating the pivot point of the member integral with the movable mouthpiece of the sheath from the pivot point of the dobby levers, or conversely is equal to half this second distance, such that of the respective movements of the cable and sheath, one is twice the other. Thus, by moving either solely the dobby lever connected to the movable mouthpiece, or solely the dobby lever connected to one end of the cable, or both levers simultaneously, relative movements of the cable and sheath are obtained of values proportional respectively to the numbers 1, 2 and 3. The end of the cable adjacent the fixed mouthpiece of the sheath can consequently assume four different positions, separated by equal distances and thus impart to the lever four different positions, each corresponding to the raising of one of the drawbars.

However, since the time of movement of the cable does not correspond to the time favorable for selection, but is anticipated, it is necessary to lock the lever located below the drawbar to be selected until the desirable time. According to one feature of the invention, the plate carrying out an alternating rectilinear movement, on which the selected drawbar is engaged, is connected to a locking plate cooperating with the lever and arranged to prevent said lever from rotating opposite the selcted drawbar, at the time of the engagement, but arranged to release the lever when the drawbar in question is entrained by the plate.

In a particular embodiment, the lever comprises a locking lug whereas the said locking plate comprises holes of the same number as the drawbars, arranged in an arc of a circle, into which the locking lug is introduced. The holes are clearly arranged on this arc of a circle, in angular positions corresponding to the particular positions of the lever when the latter is located exactly below the various drawbars.

The presence of these locking means requires that a "mechanical memory" device be located between the lever and the end of the cable, which device facilitates "memorization" of the movement which the end of the cable, controlled by the device associated with the dobby levers, carries out while the lever is locked on the said locking plate and an integral restoration of this movement after unlocking of the lever.

This "mechanical memory" device may be constituted by a stirrup member comprising lugs fixed to the end of the cable, by the extension of a rod pivoted to the lever, located between the two sides of the stirrup member and comprising cotter pins whose spacing is equal to that of the said lugs and by a spring which is trapped and compressed, around the stirrup member, between the lugs and the cotter pin.

When this device is inoperative, the spring, although compressed, is at its maximum length and keeps the lugs of the stirrup member in alignment, with the cotter pins of the extension of the rod sliding in said stirrup member.

A movement of the cable in either direction causes a compression of the spring between the lugs located on one side of the device and the cotter pin located on the opposite side, the latter remaining stationary as long as the lever is locked. At the time of unlocking, the spring is freed to extend, thus pushing back the cotter pin and consequently the rod and lever, as far as the new inoperative position imposed by the movement of the end of the cable.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
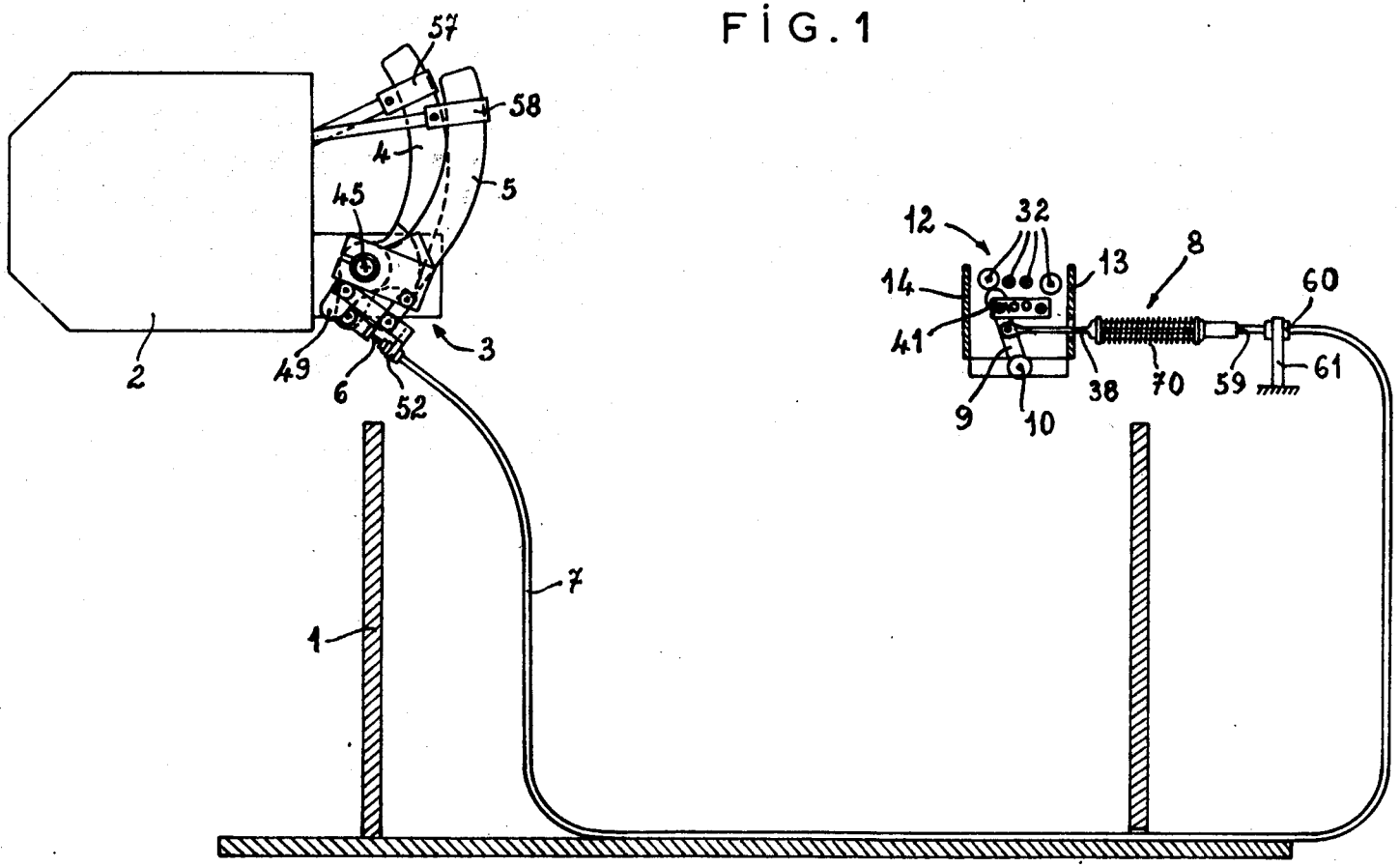
FIG. 1 is a very simplified general view of the selector installed on a loom.

The weft-thread selector according to the invention is mounted on a shuttleless loom whose frame is shown very diagrammatically at 1 and the so-called "dobby" mechanism is shown at 2 in FIG. 1, this machine comprising on its opposite side to the dobby 2, a multicolor supply, providing four weft threads of different colors.

Generally, the weft-thread selector according to the invention comprises, as shown in FIG. 1, a device 3 associated with two dobby levers 4 and 5, which controls a cable or core 6 passing through a sheath 7 (a bowden cable) and connected, through the intermediary of a "mechanical memory" device 8, to a lever 9 pivotally mounted about a horizontal pivot 10.

The lever 9 makes it possible to raise a drawbar 11 to be selected, belonging to a known device 12 comprising four drawbars, each connected to a movable thread guide making it possible to introduce one of the four weft threads.

This device 12 is shown in detail in FIGS. 2–5 and its construction corresponds essentially to the description given in U.S. Pat. No. 3,731,712.

Two slides 15 connected to a plate 16 are mounted in horizontal grooves provided in the sides of two parallel vertical cheeks 13 and 14. The two slides 15 are pivoted to rods (not shown), coupled to a lever which oscillates under the action of a cam for controlling the reciprocating movement of the plate 16.

Located side-by-side below this plate are the four drawbars 11, one end of which supports a member 17 and the other end is pivoted at 18 to a disc 19. A bolt 21, subject to the action of a thrust spring 22 and comprising a notch whose profile corresponds to that of the plate 16 is pivoted at 20 on each member 17, located just below the plate 16. The member 17 also comprises a notch 23 directed downwards, in order to be able to be supported, in the lowered or inoperative position, on a fixed transverse support 24 mounted between the two cheeks 13 and 14.

The discs 19 pivoted to the corresponding drawbars 11 are mounted to rotate freely about a shaft 25, common to all the discs, supported by the cheeks 13 and 14. In the inoperative position, i.e. when the corresponding drawbar 11 is not entrained by the plate 16, each of these discs 19 is positioned by means of a ball 26 biased by a spring and introduced into a notch 27 provided on the periphery of the disc 19. Furthermore, each of the discs 19 supports a thread guide 28 comprising, at its end, an eye 29, in which one of the four weft threads is permanently engaged.

Furthermore, each drawbar 11 is connected, by means of a spring 30 pulling it downwards, to a fixed transverse rod 31 connecting the two cheeks 13 and 14.

Figure 2:
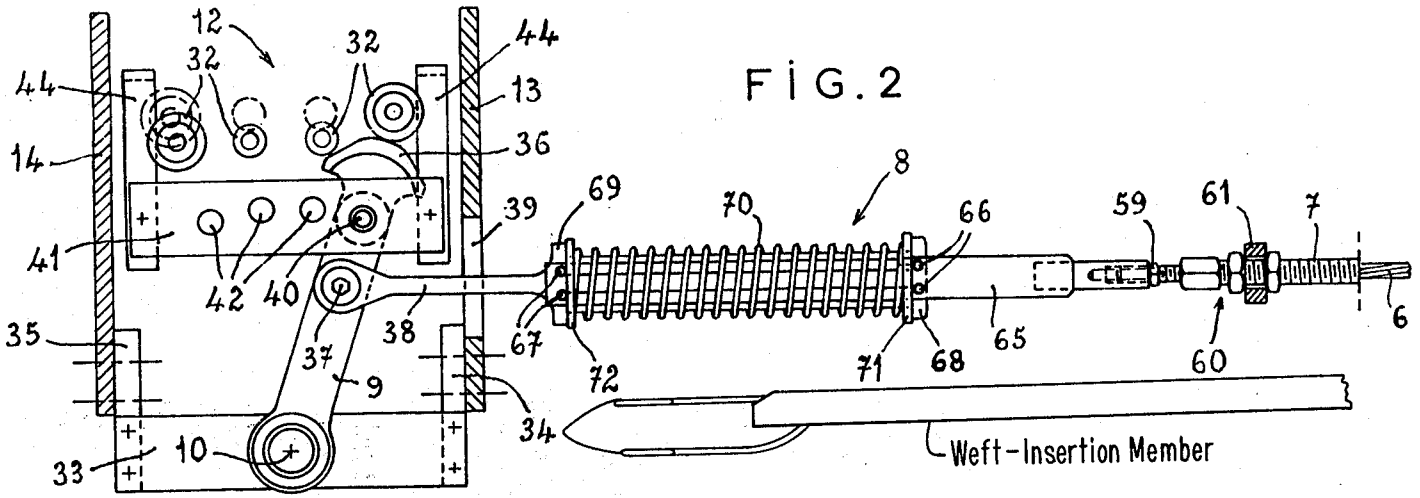
FIG. 2 is a front view, in partial section, of the part of the selector comprising the lever making it possible to raise the drawbar to be selected and the "mechanical memory" device.
Figure 3:
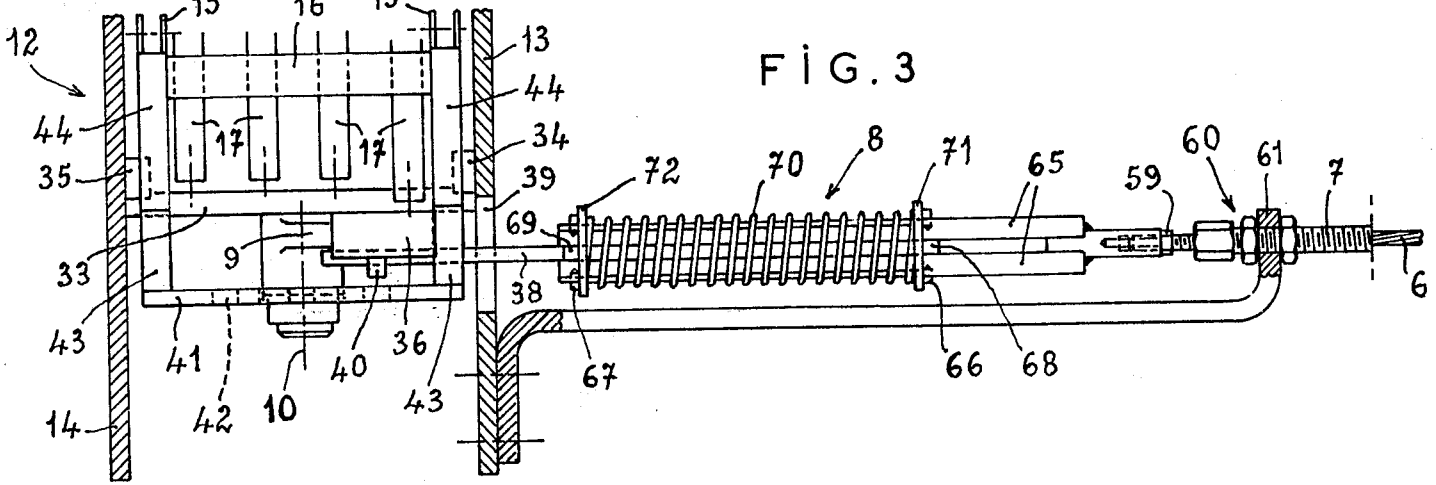
FIG. 3 is a plan view, in partial section, corresponding to FIG. 2.
Figure 4:
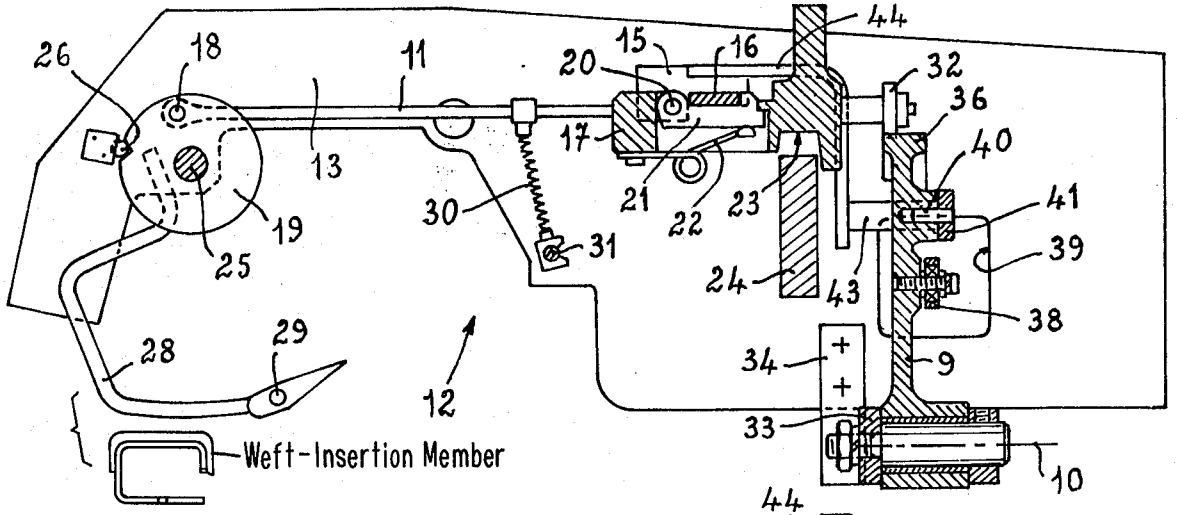
FIG. 4 is a side view, in partial section, showing the said lever and the selcted drawbar, in the position of engagement on the plate.
Figure 5:
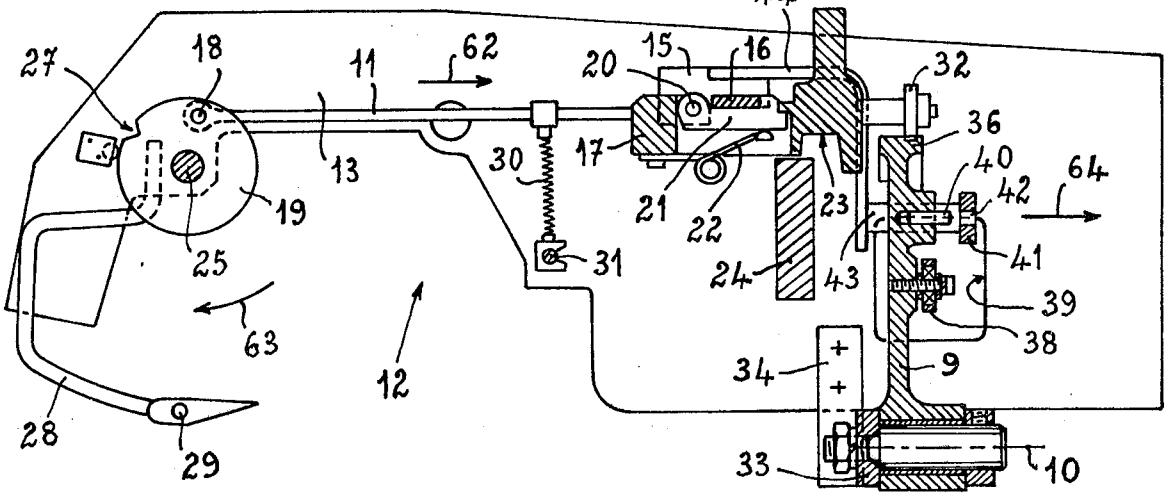
FIG. 5 is a side view similar to FIG. 6, the selected drawbar being entrained by the plate.

According to the invention, the member 17 integral with each drawbar 11 comprises, opposite the drawbar, a roller 32 which is shown clearly in FIGS. 2, 4 and 5, and indicated solely by its axis in FIG. 3, for the sake of clarity of the drawings.

The lever 9 which cooperates with these rollers 32 is pivoted at 10 on a transverse member 33, fixed to the lower part of the cheeks 13 and 14 by means of small plates 34 and 35, respectively. The pivot axis 10 of the lever 9 is located at the center of the transverse member 33 and the four rollers 32 are arranged symmetrically on the trajectory in the shape of an arc of a circle described by the enlarged end 36 of the lever 9.

The lever 9 is pivoted at 37, in its central part, to a rod 38 passing through the cheek 13 through an opening 39 and connecting the lever 9 to the "mechanical memory" device 8 which will be described hereinafter.

This lever also comprises, between its enlarged end 36 and the pivot 37, a locking lug 40 cooperating with a locking plate 41 in which are provided four holes 42 arranged along an arc of a circle. The locking plate 41 is rigidly connected to the plate 16 by means of two tierods 43 and two angle irons 44 fixed to the slides 15.

Figure 6:
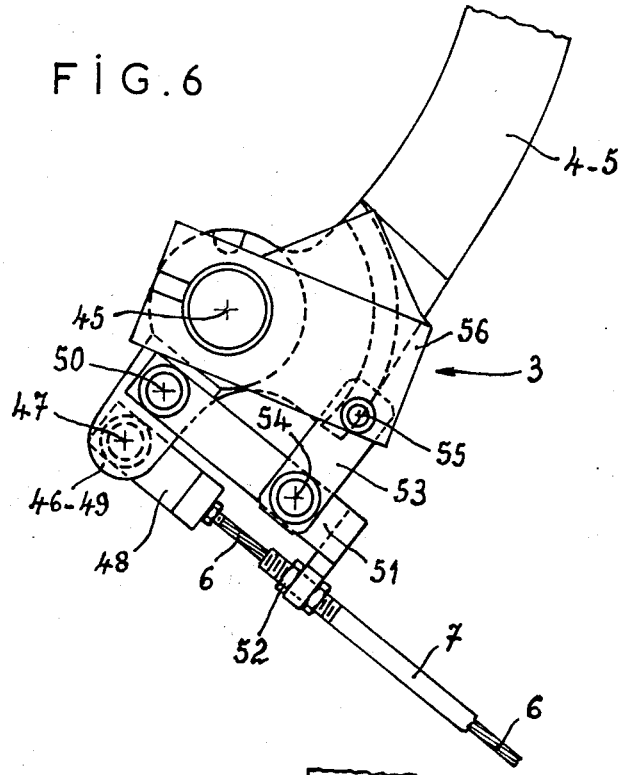
FIG. 6 is a detail view, drawn to an enlarged scale, of the device for controlling the movements of the cable, associated with two dobby levers.
Figure 7:
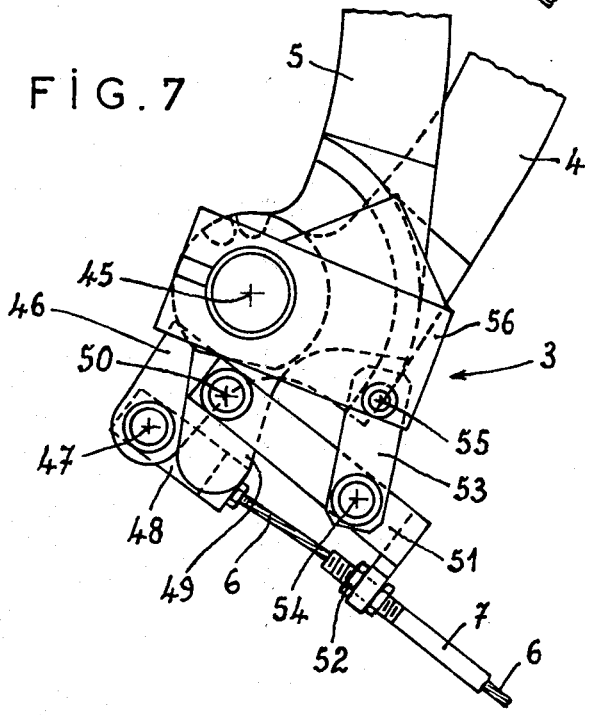
FIG. 7 shows the same control device, in a different position from that of FIG. 6.

The device 3 for controlling the movements of the cable 6, associated with the dobby levers 4 and 5, is illustrated in detail in FIGS. 6 and 7.

The two levers 4 and 5 are pivoted about a fixed common pivot 45. Beyond the pivot 45, the first lever 4 comprises an extension in the form of a bracket 46 at the end of which is pivoted, about a pivot 47, a part 48 integral with the end of the cable 6. Similarly, beyond the pivot 45, the second lever 5 comprises an extension in the form of a bracket 49 to which is pivoted, about a pivot 50, a part 51 integral with the mouthpiece 52 of the sheath 7 through which the cable 6 passes. The levers 4 and 5 and their respective extensions 46 and 49 are superimposed in the particular position of FIG. 6, but appear separately in FIG. 7, showing the same device 3 in another position.

The part 51 pivoted on the extension 49 of the lever 5 is supported by a connecting rod 53 pivoted at one end to said part 51 at 54 and at the other end to a fixed member 55 at 56. The four pivots 45, 50, 54 and 56 constitute the corners of a deformable parellelogram which makes it possible to keep the mouthpiece 52 of the sheath 7 fixed to the part 51 parallel to itself despite the movements of the lever 5.

Furthermore, the distance separating the two pivot points 45 and 47 is substantially equal to twice the distance separating the two pivot points 45 and 50. By adjusting the respective adjusting collars 57 and 58 of the levers 4 and 5, shown in FIG. 1, this makes it possible for the cable 6 to describe a path twice that of the sheath 7, for the same rotation of the lever 4 or 5.

Figure 8:
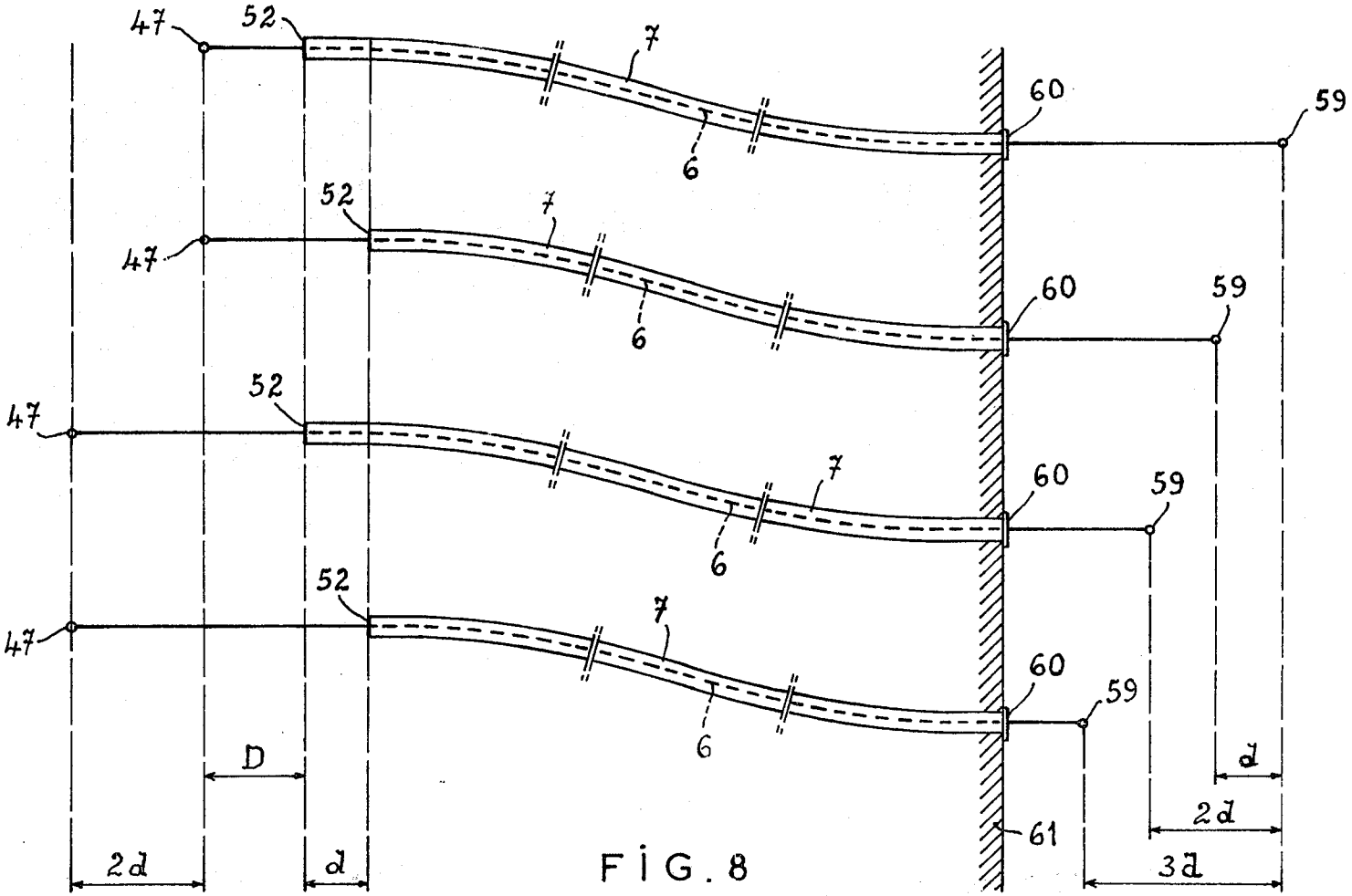
FIG. 8 is a very diagrammatic view illustrating the operation of this device for controlling the movements of the cable.

Thus, since the two dobby levers 4 and 5 may each occupy two extreme angular positions, one independent of the other, which corresponds to four different relative positions, the distance separating the pivot point 47 and the mouthpiece 52 may have four different values linked by a very particular relationship as shown in FIG. 8.

In a first position shown at the top in FIG. 8, this distance is minimal and its value is designated by D.

If, from this position, the lever 5 connected to the mouthpiece 52 of the sheath is moved from one extreme position to the other, since the lever 4 connected by the pivot 47 to the cable 6 remains stationary, the distance in question is increased by a certain value d and thus becomes equal to D + d. This case corresponds to the second position from the top in FIG. 8.

Conversely, if the lever 4 connected to the cable 6 is moved from one extreme position to the other, the lever 5 connected to the sheath 7 remaining in its initial position, the distance in question is increased by the value 2d, since the cable describes a distance twice that of the sheath. The distance in question thus become equal to: D + 2d, this case corresponding to the third position from the top in FIG. 8.

Finally, if the two levers 4 and 5 are brought into their extreme position different from the initial position, the two effects described above are added together and the distance in question, increased by the sum d + 2d; thus becomes equal to: D + 3d. This case corresponds to the position shown at the bottom of FIG. 8.

To summarize, the end of the cable 6 in question and the corresponding muthpiece 52 of the sheath 7 may occupy four distinct relative positions, separated by distances all equal to the same value d.

The other end 59 of the cable 6 could thus also occupy four relative positions with respect to the corresponding mouthpiece 60 of the sheath 6, linked by the same relationship. However, if the first mouthpiece 52 is movable and if the cable/sheath arrangement is free to deform, as shown in FIG 1, on the contrary, the second mouthpiece 60 is anchored at 61 to a fixed part of the machine, which in the particular embodiment shown in FIG. 3 is a fitting integral with the cheek 13 belonging to the device 12.

Thus, with respect to the machine, the end 59 of the cable 6 will occupy four relative positions separated by distances all equal to the same value d, as shown in the right-hand part of FIG. 8.

If one disreagrds the effect of the "mechanical memory" device 8, inserted between the end 59 of the cable 6 and the rod 38 pivoted to the lever 9, it therefore appears that the cable 6 imparts four different, regularly spaced angular positions to this lever, according to the position of the dobby levers 4 and 5. In each of these positions, the enlarged end 36 of the lever 9, acting in the manner of a ramp, causes the raising of one of the four rollers 32, therefore of one of the drawbars 11 of the device **12*m* as shown in FIGS. 2 and 4**.

When the lever 9 thus raises one of the drawbars 11, for example the drawbar located closest to the cheek 13, the bolt 21 connected to the drawbar in question engages under the plate 16 as shown in FIG. 4. If the plate is located exactly above the notch in the bolt 21 at the time of selection, engagement is immediate. If the plate 16 is not yet in position facilitating immediate engagement, the bolt 21 is partly eclipsed by rotation about the pivot 20, thus compressing the spring 22. When the plate 16 is located exactly above the notch in the bolt 21, the latter engages under the thrust of spring 22.

In the two preceding hypotheses, after engagement of the bolt 21, the plate 16 entrains the drawbar 11 in question in its reciprocating movement, firstly pulling the latter in the direction of arrow 62 in FIG. 5. This movement of the drawbar 11 rotates the disc 19 about the pivot 25 in the direction of arrow 63, in order to bring the eye 29 of the thread guide 28 above the passage of the weft insertion member which is not shown.

It should be noted from FIG. 5 that from the beginning of its movement, the selected drawbar 11 is no longer able to drop back, even if the lever 9 which has raised the latter has pivoted, on account of the profile and relative position of the member 17 connected to the drawbar in question on the one hand and on account of the transverse support 24 on the other hand.

When the plate 16 and the raised drawbar 11 return to the position of FIG. 4 after a forwards and return movement, two conditions may occur:

In the case where a change of weft thread is desired, the end 36 of the lever 9 is brought under a roller 32 associated with another drawbar 11. This roller is raised as shown in dot-dash lines in FIG. 2 and the previously selected drawbar drops, under the joint action of its weight and the traction of the spring 30. As aforementioned, this drawbar returned to the lower position rests, by means of the notch 23 of the member 17, on the transverse support 24. The new drawbar selected is entrained by the plate 16 in the same way as previously.

In the case where no change in the weft thread is desired, the end 36 of the lever 9 remains under the roller 32 of the previously selected drawbar 11, as shown in FIG. 4. Therefore, this drawbar does not drop and its bolt 21 remains engaged under the plate 16, such that the same drawbar 11 will be entrained as previously at the time of the following forward and return movement of the plate, such that the same thread guide 28 will once more be actuated.

This general explanation of the operation assumes that the movements of the lever 9, therefore of the cable 6, take place exactly at the time favorable for selection, which is not the case in reality, on account of the movements of the dobby levers 4 and 5 which control the warp threads and the movements of the cable 6. In reality, there is anticipation of the movements of the cable, which necessitates locking of the lever 9 until the favorable time and a "memorization" of the movement which the cable carries out while the lever is locked, hence the necessity of the locking plate 41 and the memorization device 8, whose operation is as follows When the rigid assembly constituted by the plate 16 and the locking plate 41, to which an alternating rectilinear movement is imparted, is located in a position close to that of FIG. 4, the lug 40 of the lever 9 is introduced into one of the holes 42 in the plate 41, such that the lever 9 necessarily retains the angular position into which it has been brought, until the bolt 21 of the raised drawbar 11 engages under the plate 16.

When the plate 16 entrains this drawbar 11 therewith, as shown in FIG. 5, the locking plate 41 is moved in the direction of arrow 64 and thus releases the lug 40. The lever 9 is thus free to assume its new "memorized" position in the device 8, at least in the case where there is effectively a change of weft thread. As explained above, this anticipated movement of the lever 9 does not cause a premature drop of the selected drawbar 11, on account of the profile and relative position of the member 17 and the transverse support 24.

When after a forward and return movement, the plate 16 once more reaches a position close to that of FIG. 4, the locking lug 40 of the lever 9 which has been moved, is introduced into another hole 42 in the plate 41 and the same process is repeated.

This locking and the resulting delayed moement of the lever 9 are authorized by the device 8 for "memorizing" the movements of the cable 6, achieved as follows: fixed to the end 59 of the cable 6 is a stirrup member 65 having two parallel sides comprising lugs 66 and 67. The rod 38 pivoted at 37 to the lever 9 is extended between the two sides of the stirrup member 65 and it comprises two transverse cotter pins 68 and 69, the spacing of which is equal to that of the lugs 66 and 67.

A helical spring 70 surrounding the stirrup member 65 and the rod 38, is trapped between the lugs 66 and 67 and the cotter pins 68 and 69 and compressed between these members. FIGS. 9 to 13 show the principle of this device 8, whereas FIGS. 2 and 3 illustrate a particular embodiment of the latter, in which the spring 70 is supported on the lugs 66 and 67 and on the cotter pins 68 and 69 by means of washers 71 and 72.

FIGS. 9 to 13 illustrate the operation of the "mechanical memory" device 8 in the case of a particular sequence taken as an example, during which the drawbars to be selected are the first, the third and the second from the right in succession.

Figure 9:
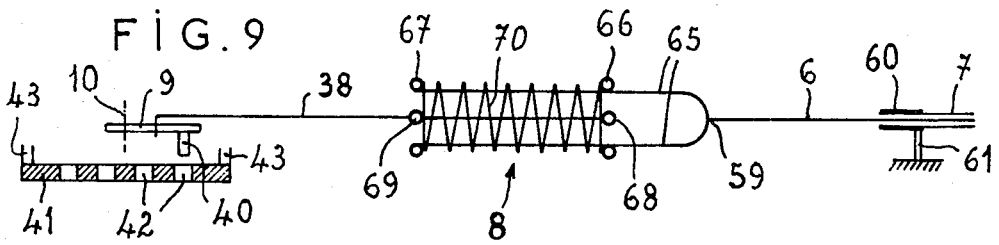
FIGS. 9–13 are diagrams explaining the operation of the "mechanical memory" device.

In the initial position, shown in FIG. 9, the lever 9 is not locked by its lug 40 on the plate 41 and it is located below the roller 32 connected to the drawbar 11 located furthest to the right, which is the drawbar to be selected first from the starting time in question. The spring 70 is compressed to the minimum extent, the lugs 66 and 67 being located opposite the respective cotter pins 68 and 69.

Figure 10:
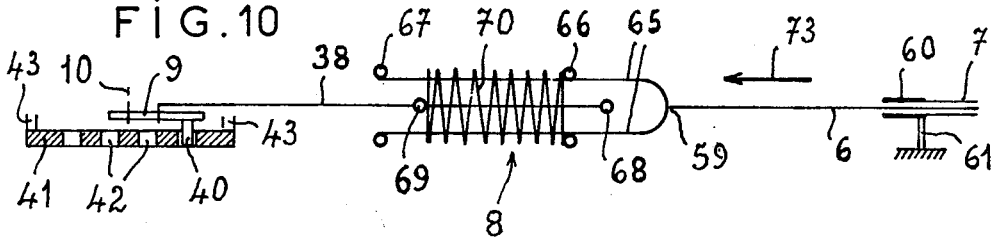

At the time of the return movement of the plate 16 entraining the previously selected drawbar, the lug 40 of the lever 9 is introduced into the hole 42 located furthest to the right on the plate 41, as shown in FIG. 10. When locking has been achieved, the drawbar located furthest to the right is selected and entrained as previously described.

It is assumed that the drawbar to be selected immediately after the latter is the third from the right, which means that the end 59 of the cable 6 will be moved toward the left by a length 2d, as indicated by the arrow 73, in order to bring the lever 9 under the roller connected to this third drawbar.

As long as the lever 9 remains locked to the plate 41, the stirrup member 65 which has moved towards the left with the cable 6 compresses the spring 70 between its lugs 66 and the cotter pin 69 of the rod 38 which itself remains stationary, as shown in FIG. 10.

Figure 11:
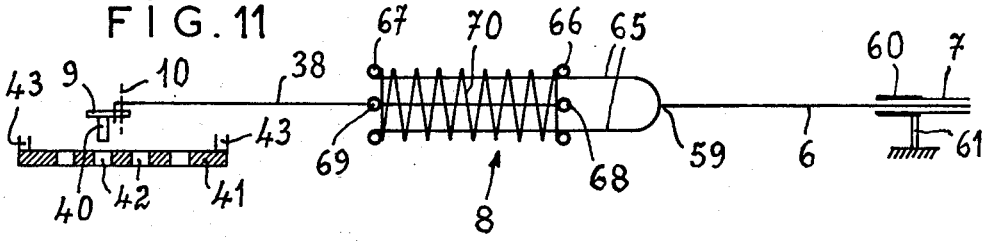

At the time of unlocking, the spring 70 expands and pushes the rod 38 by means of the cotter pin 69. When the spring 70 resumes its maximum length, once more coming into abutment against the lug 67 and the cotter pin 68, the rod 38 is moved by the length 2d corresponding to the movement of the cable 6. The lever 9 is thus brought exactly below the roller connected to the third drawbar, as shown in FIG. 11.

Locking of the lever 9 thus takes place in the third hole 42 of the plate 41 and the third drawbar is selected and entrained.

It will be assumed that the drawbar to be selected immediately after the latter is the second from the right, which means that the end 59 of the cable 6 will be moved towards the right by a length d, as indicated by the arrow 74, in order to bring the lever 9 underneath the roller connected to this second drawbar.

Figure 12:
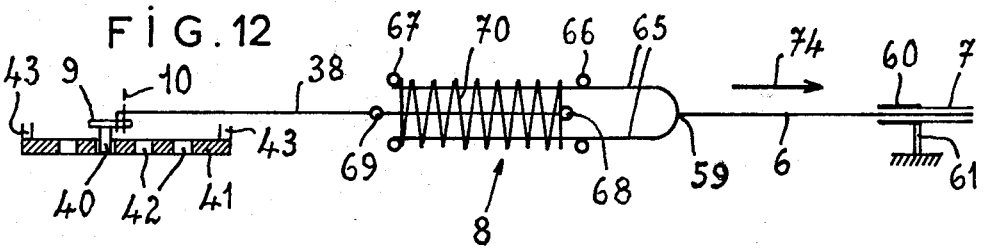

As long as the lever 9 remains locked on the plate 41, the stirrup member 65 which is moved towards the right with the cable 6, compresses the spring 70, between its lug 67 and the cotter pin 68 of the rod 38 which itself, remains stationary, as shown in FIG. 12.

Figure 13:
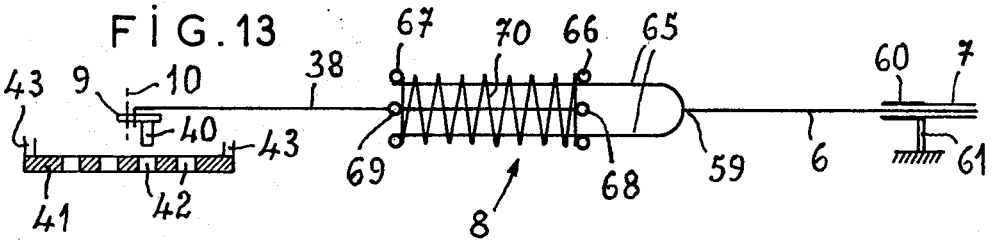

At the time of unlocking, the spring 70 expands and pulls the rod 38 by means of the cotter pin 68. When the spring 70 resumes its maximum length, once more coming into abutment against the lug 66 and the cotter pin 69, the rod 38 is moved by the length d corresponding to the movement of the cable 6. The lever 9 is thus brought exactly below the roller connected to the second drawbar, as shown in FIG. 13.

It will be easily understood that, if the same weft thread is selected twice in succession, the cable 6 is not moved during locking of the lever 9 and the "memorization" device 8 does not intervene, the spring 70 retaining its maximum length.

I claim:

1. In a weft-thread selecting device for a shuttleless loom, in which each of a plurality of weft threads is engaged in a respective eye of a thread guide mounted to oscillate about a pivot and coupled to a drawbar which can be selected by being raised and engaged on a plate which is provided with means for imparting to the plate an alternating rectilinear movement such that the corresponding thread guide brings the weft thread selected into a passage of a weft-insertion member of the loom, a plurality of such drawbars being arranged side-by-side, the improvement wherein the raising of the selected drawbar is controlled by a first lever pivotally mounted about a pivot, able to cooperate with all the drawbars and connected to one end of a cable passing through a sheath whose mouthpiece adjacent this end is fixed, the other end of the cable and the corresponding mouthpiece of the sheath being movable and operatively connected to a device associated with two dobby levers for controlling the movement of said other end of the cable and the corresponding sheath mouthpiece.

2. The improvement defined in claim 1 wherein each drawbar comprises a roller cooperating with an end of the first lever, the various rollers being arranged on a trapectory in the shape of a circular arc described by said end of the first lever.

3. The improvement defined in claim 1 wherein said other end of the cable is connected to a part pivoted on an extension of a first of said dobby levers, whereas the corresponding movable mouthpiece of the sheath is connected to a part pivoted on an extension of a second of said dobby levers.

4. The improvement defined in claim 3 wherein the part connected to the movable mouthpiece of the sheath is supported by a connecting rod pivoted to a fixed member arranged such that the pivot point of the dobby levers, the pivot point of the part on the extension of the second dobby lever, the pivot point of the connecting rod on the said part connected to said mouthpiece, and the pivot point of the connecting rod on the fixed member constitute the corners of a deformable parallelogram.

5. The improvement defined in claim 3 wherein the distance separating the pivot point of the part connected to said other end of the cable and the pivot point of the dobby levers is substantially equal to twice the distance separating the pivot point of the part connected to the movable mouthpiece of the sheath and the pivot point of the dobby levers such that, of the respective movements of the cable and sheath, one is twice the other.

6. The improvement defined in claim 3 wherein the distance separating the pivot point of the part connected to said other end of the cable and the pivot point of the dobby levers is substantially equal to half the distance separating the pivot point of the part connected to the movable mouthpiece of the sheath and the pivot point of the dobby levers such that of the respective movements of the cable and sheath one is twice the other.

7. The improvement defined in claim 6 wherein the first lever comprises a locking lug and said locking plate comprises holes in the same number as the drawbars arranged along a circular arc into which the locking lug is introduced.

8. The improvement defined in claim 1 wherein in that the plate carrying out alternating rectilinear movement on which the selected drawbar is engaged is connected to a locking plate cooperating with the first lever and arranged in order to prevent said first lever from rotating opposite the drawbar selected, at the time of the engagement, but to release the lever when the respective drawbar is entrained by the plate.

9. The improvement defined in claim 7 wherein the first lever is connected to the first-mentioned end of the cable by means of a mechanical memory device facilitating memorization of the movement which the end of the cable controlled by the device associated with the dobby levers carries out while the first lever is locked on the said locking plate and an integral restoration of this movement after unlocking of the lever.

10. The improvement defined in claim 9 wherein the mechanical memory device is constituted by a stirrup member comprising lugs fixed to the end of the cable, by the extension of a rod pivoted to the first lever, located between the two sides of the stirrup member and comprising cotter pins whose spacing is equal to that of the said lugs, and by a spring which is trapped and compressed around the stirrup member between the lugs and the cotter pins.

11. The improvement defined in claim 10 wherein the spring is supported on the lugs and on the cotter pins through the intermediary of washers.

* * * * *